United States Patent [19]

Suzuki et al.

[11] Patent Number: 4,880,356

[45] Date of Patent: Nov. 14, 1989

[54] METHOD OF CONTROLLING WOBBLE PLATE TYPE COMPRESSOR

[75] Inventors: Shinichi Suzuki; Soukichi Hibino; Takahiro Hamaoka; Masaki Ohta, all of Kariya, Japan

[73] Assignee: Kabushiki Kaisha Toyoda Jidoshokki Seisakusho, Aichi, Japan

[21] Appl. No.: 230,332

[22] Filed: Aug. 9, 1988

[30] Foreign Application Priority Data

Aug. 10, 1987 [JP] Japan ..... 62-200532

[51] Int. Cl.[4] ..... F04B 1/26; B60H 1/32; F25B 1/02

[52] U.S. Cl. ..... 417/53; 417/222; 62/133; 62/227; 62/228.5

[58] Field of Search ..... 62/133, 227, 228.5; 417/222 S, 53

[56] References Cited

U.S. PATENT DOCUMENTS 4,526,516 7/1985 Swain ..... 417/222 S
4,747,754 5/1988 Fujii et al. ..... 417/222 S

FOREIGN PATENT DOCUMENTS 2153922 8/1985 United Kingdom ..... 417/222 S

*Primary Examiner*—William L. Freeh
*Attorney, Agent, or Firm*—Burgess, Ryan & Wayne

[57] ABSTRACT

In a wobble plate type compressor having a wobble plate that converts a rotational motion of a rotatable drive plate having a variable angle of inclination to a linear reciprocating motion of a piston, a method of controlling the wobble plate type compressor to control a displacement of the compressor by changing an angle of inclination of the wobble plate according to a pressure difference between a pressure in a crankcase chamber acting on one side of the piston and a suction pressure acting on the other side of the piston. A solenoid-operated control valve is disposed in a pressure control passage extending from a discharge chamber to the crankcase chamber. The control valve is opened and closed to control the above-mentioned pressure difference, thus controlling the angle of inclination of the wobble plate. An opening of the control valve is increased during a period in which the displacement of the compressor is to be reduced, according to a displacement rapid reduction command signal. In an initial stage of this period, the opening of the control valve is made temporarily wider than in the remaining period.

5 Claims, 3 Drawing Sheets

METHOD OF CONTROLLING WOBBLE PLATE TYPE COMPRESSOR

BACKGROUND OF THE INVENTION

1. Field of the Invention

The present invention relates to a method of controlling the operation of a wobble plate type compressor provided with a wobble plate for converting a rotational motion of a rotatable drive plate having a variable angle of inclination to a linear reciprocating motion of pistons. The rotatable drive plate and wobble plate are received in a crankcase chamber of the compressor, and a displacement of the compressor is controlled by changing an angle of inclination of the wobble plate according to a pressure difference between a pressure in the crankcase chamber acting on one side of each piston and suction pressure acting on the other side of each piston.

2. Description of the Related Art

U.S. Pat. No. 4,747,754 to Fujii et al. discloses a variable displacement wobble plate type compressor with a solenoid-operated wobble angle control valve. This control valve is disposed in a passage extending from a crankcase chamber to a discharge chamber of the compressor, and the control valve is opened and closed according to a pressure detection signal from a suction pressure detector, a temperature detection signal from a temperature gauge, etc., to control a pressure level in the crankcase chamber, thus controlling a displacement of the compressor. The compressor is connected to an engine of a vehicle, and when the engine is subjected to a large load upon, for example, acceleration, the displacement of the compressor is reduced to reduce the load on the engine to provide a smooth acceleration and improve the drivability of the vehicle. To this end, the solenoid-operated control valve must be quickly opened to rapidly increase a pressure level in the crankcase chamber and instantaneously reduce the displacement of the compressor.

Nevertheless, if the pressure level in the crankcase chamber that has been increased to quickly reduce the displacement of the compressor is kept as it is during the acceleration of the vehicle, an excessive load may be applied to connections between each compressor piston and a piston rod, between the piston rod and a wobble plate, and between the wobble plate and a rotatable drive plate of the compressor, to damage these connections. If the pressure increase in the crankcase chamber is suppressed to avoid this damage, the displacement of the compressor may not be sufficiently lowered in a short time.

SUMMARY OF THE INVENTION

An object of the present invention is to solve the problems encountered by the conventional method for controlling the operation of a variable displacement wobble plate type compressor.

Another object of the present invention is to provide a method of controlling the operation of a variable displacement wobble plate type compressor whereby a rapid reduction in displacement of the variable displacement compressor is provided on demand.

A further object of the present invention is to provide a method of controlling the operation of a variable displacement wobble plate type compressor accommodated in a refrigerating system of a vehicle, whereby a good drivability of the vehicle is maintained.

In accordance with the present invention, there is provided a method of controlling the operation of a variable displacement wobble plate type compressor provided with: a cylinder block having formed therein a plurality of cylinder bores to receive therein compressor pistons: a housing means arranged on axially opposite ends of the cylinder block for defining therein a suction chamber for a low pressure refrigerant gas to be compressed, a discharge chamber for a compressed high pressure refrigerant gas, and a crankcase chamber for receiving a pressure responsive displacement varying means including a drive shaft connectable to a rotative drive source means, a drive plate mounted around the drive shaft and capable of rotating with the drive shaft and varying an inclination angle thereof with respect to a plane vertical to the axis of the drive shaft and a wobble plate non-rotatably supported on the drive plate, the wobble plate being inclined with the drive plate in response to a pressure difference between the crankcase chamber and the suction chamber, and connected to the compressor pistons via piston rods to cause a reciprocating motion of the compressor pistons with variable strokes, to thereby vary the displacement of the compressor; a solenoid-operated control valve means arranged in a pressure control passageway means extending from the discharge chamber to the crankcase chamber for changing an extent of fluid communication between the crankcase and discharge chambers; and a control means for electrically controlling the operation of the solenoid-operated control valve. The method comprises the steps of:

generating a predetermined command signal indicating a rapid reduction in a displacement of the compressor by the control means in response to a demand for a reduction of the displacement of the compressor;

supplying the solenoid-operated control valve with an electrical energizing signal having a predetermined intensity, to increase the extent of the fluid communication between the crankcase and discharge chambers in response to the predetermined command signal during a time period in which the demand for a reduction of the displacement of the compressor is continued;

intensifying the electrical energizing signal supplied to the solenoid-operated control valve for a predetermined initial part of the time period in which the demand for a reduction of the displacement of the compressor continues to thereby maximize the extent of the fluid communication between the crankcase and discharge chambers; and restoring the electrical energizing signal supplied to the solenoid-operated control valve to the predetermined intensity for the remaining part of the time period in which the demand for a reduction of the displacement of the compressor is continued.

When the displacement of the variable displacement compressor must be rapidly reduced due to acceleration of a vehicle provided with a refrigerating system in which the compressor is accommodated, the rapid displacement reduction command signal is generated to increase the opening of the solenoid-operated control valve for a time interval during which the displacement must be reduced. In the initial stage of the time period, namely, in an initial pressure rising period of the crankcase chamber, the opening of the control valve is temporarily increased further than that in the remaining time period, so that a pressure level in the crankcase chamber may be rapidly increased to rapidly reduce the displacement. Then, the opening of the control valve is suppressed to an extent sufficient to maintain the reduced displacement.

Therefore, an excessively increased pressure is not maintained in the crankcase chamber for a long time, and as a result, damage to the connections between the pistons and the piston rods, between the piston rods and the wobble plate, and between the wobble plate and the rotatable drive plate is prevented, and a quick reduction of the displacement is realized.

BRIEF DESCRIPTION OF THE DRAWINGS

The above and other objects, features, and advantages of the present invention will be made apparent from the ensuing description of an embodiment thereof with reference to the accompanying drawings wherein.

DESCRIPTION OF THE PREFERRED EMBODIMENTS

Figure 1:
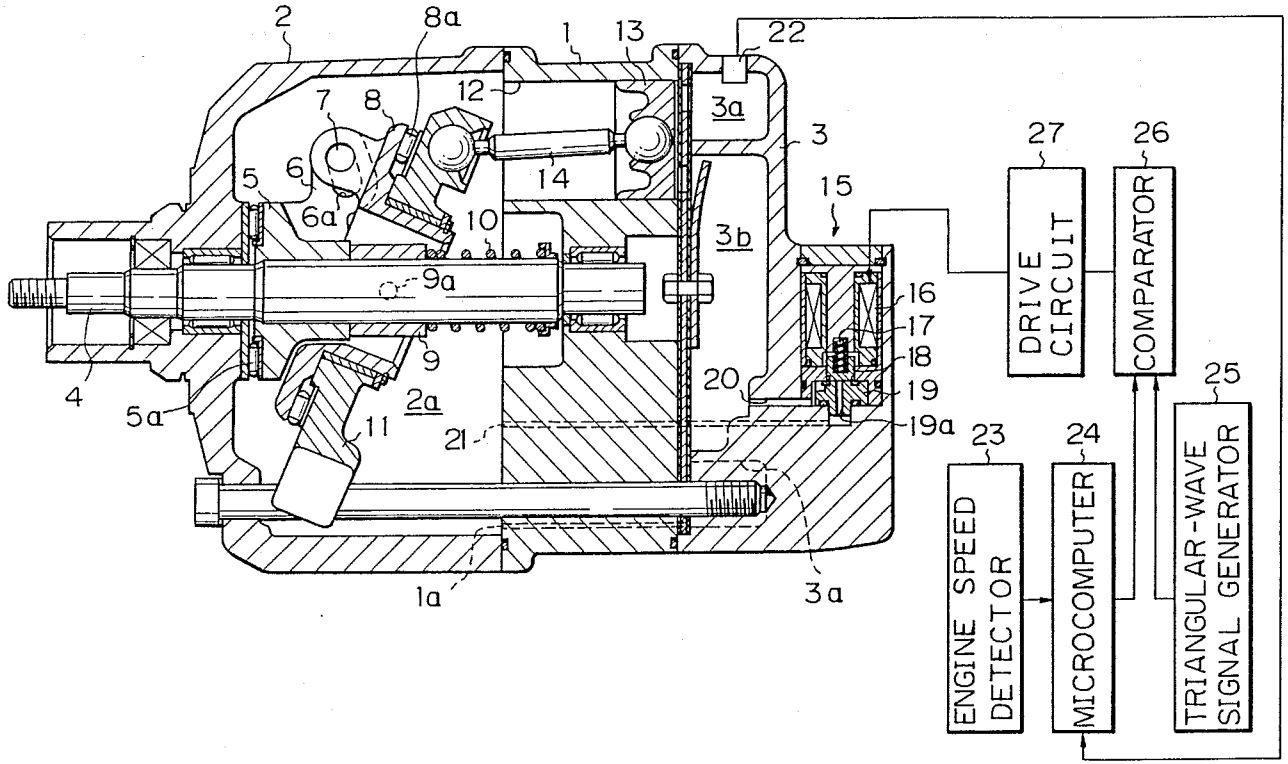
FIG. 1 is a longitudinal sectional view with a block diagram, illustrating a variable displacement wobble plate type compressor controlled by the controlling method according to an embodiment of the present invention.

An embodiment of the present invention will be described with reference to the drawings.

A wobble plate type compressor according to the embodiment of the present invention has a housing which comprises a cylinder block 1, a front housing (crankcase) 2 connected to the front side of the cylinder block 1 and a rear housing 3 connected to the rear side of the cylinder block 1. The cylinder block 1 and front housing 2 rotatably support a drive shaft 4 to which a rotatable support member 5 is fixed. The rotatable support member 5 is rotatable with respect to the front housing 2 through a thrust bearing 5a. On the rotatable support member 5, opposite to the thrust bearing 5a, a support arm 6 is projectingly formed. An end of the support arm 6 is provided with a long throughhole 6a in which a pin 7 slidably engages. The pin 7 is connected to a rotatable drive plate 8 having a variable angle of inclination.

A sleeve 9 is slidably disposed around the drive shaft 4 next to the rotatable support member 5 opposite to the thrust bearing 5a, and the sleeve 9 is urged by a presser spring 10 toward the rotatable support member 5. A pair of shaft pins 9a (only one is shown in FIG. 1) protrude radially and oppositely from the sleeve 9 to engage with holes (not shown) prepared on the rotatable drive plate 8. With this arrangement, the rotatable drive plate 8 is capable of wobbling about the shaft pins 9a and along the drive shaft 4.

The rotatable drive plate 8 supports a non-rotatable wobble plate 11 through a thrust bearing 8a. A crankcase chamber 2a in the front housing 2, a suction chamber 3a and a discharge chamber 3b in the rear housing 3 are connected to each other through cylinder bores 12 formed through the cylinder block 1. Each piston 13 is disposed in the cylinder bores 12 and connected to the wobble plate 11 with piston rods 14. Therefore, a rotational motion of the drive shaft 4 is converted into a wobbling motion of the wobble plate 11 through the rotatable drive plate 8 so that the pistons 13 may reciprocate in the corresponding cylinder bores 12. These motions cause a refrigerant gas to be sucked from the suction chamber 3a into the cylinder bores 12, and compressed and discharged into the discharge chamber 3b.

A pressure in the crankcase chamber 2a acts on one side of each of the pistons 13, and a suction pressure acts on the other side of each of the pistons 13. Depending on a pressure difference between these two pressures acting on the opposite sides of respective pistons 13, a stroke of respective piston 13 changes, to change an angle of inclination of the wobble plate 11, and thus change a displacement of the compressor.

At lower part of the cylinder block 1, a pressure releasing passage 1a extends from the crankcase chamber 2a to the suction chamber 3a to suppress a pressure increase in the crankcase chamber 2a.

A protruding end portion of the rear housing 3 contains a solenoid-operated control valve 15. A solenoid 16 of the valve 15 attracts, when excited, a valve element 18 against a presser spring 17. The valve element 18 usually closes an upper opening of a valve hole 19a due to the action of the presser spring 17. The upper opening of the valve hole 19a is connected to the discharge chamber 3b via a passage 20, while a lower opening of the valve hole 19a is connected to the crankcase chamber 2a via a passage 21. Through these passages, the discharge chamber 3b communicates with the crankcase chamber 2a when the solenoid 16 is excited.

The solenoid-operated control valve 15 is opened and closed in response to a command voltage signal generated by a microcomputer 24 that generates the command voltage signal according to a detection signal from a pressure detector 22 to detect a pressure level in the suction chamber 3a and a detection signal from an engine speed detector 23. The command voltage signal from the microcomputer 24 is superposed and compared in a comparator 26 with a triangular-wave signal Δ from a triangular-wave signal generator 25. As shown in FIG. 3A, a rectangular control voltage signal U corresponding to the superposed regions of the triangular-wave signal Δ and command voltage signal V is output from the comparator 26 to a drive circuit 27. According to a duty ratio of the rectangular control voltage signal U, an operation of the solenoid-operated control valve 15 is controlled. If the duty ratio increases, a pressure level in the crankcase chamber 2a is increased and, if the duty ratio decreases, the pressure level in the crankcase chamber 2a is decreased.

Figure 4:
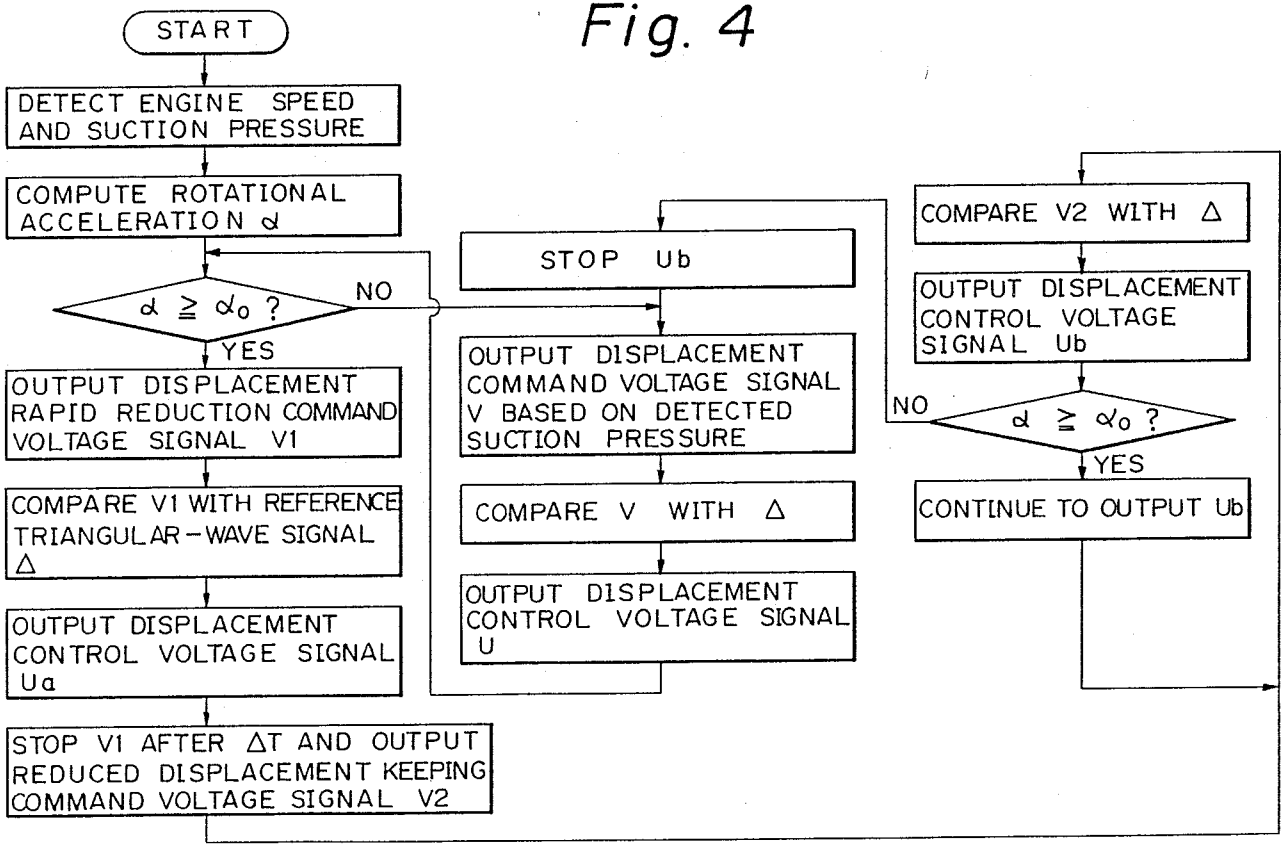
FIG. 4 is a flowchart showing control sequences of the method of the present invention.

FIG. 4 is a flowchart showing control sequences of the solenoid-operated control valve 15. A method of controlling the wobble plate type compressor according to the present invention will be described with reference to the flowchart.

The microcomputer 24 obtains engine speed information from the engine speed detector 23 to compute a rate of increase or decrease of engine rotational speed (hereinafter called the rotational acceleration) $\alpha$, and judges whether or not the computed rotational acceleration $\alpha$ is larger than a set value $\alpha_0$ (>0).

If the computed rotational acceleration $\alpha$ is less than the set value $\alpha 0$, the microcomputer 24 outputs a displacement command voltage signal V shown in FIG. 3A according to a detected suction pressure from the pressure detector 22. Then, the comparator 26 superposes and compares the displacement command voltage signal V with the triangular-wave signal $\Delta$ to output a rectangular displacement control voltage signal U corresponding to superposed regions of the signals V and $\Delta$ to the drive circuit 27. According to the displacement control voltage signal U which represents a valve opening amount, the solenoid-operated control valve 15 is opened to adjust an amount of high-pressure refrigerant gas to be supplied from the discharge chamber **3*b* to the crankcase chamber 2*a* via the pressure control passage constituted with the passage 20, valve hole 19*a*, and passage 21. As a result, a pressure level in the crankcase chamber 2*a*** that affects the compressor displacement is controlled according to the suction pressure as indicated with curve C1 of FIG. 2.

Figure 3B:
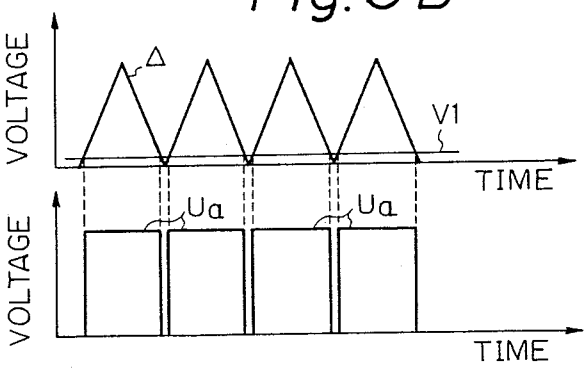
FIG. 3B is a graph showing a displacement control voltage signal obtained according to a superposed comparison of the reference triangular-wave signal and a displacement rapid reduction command voltage signal generated in response to a computed acceleration.
Figure 3A:
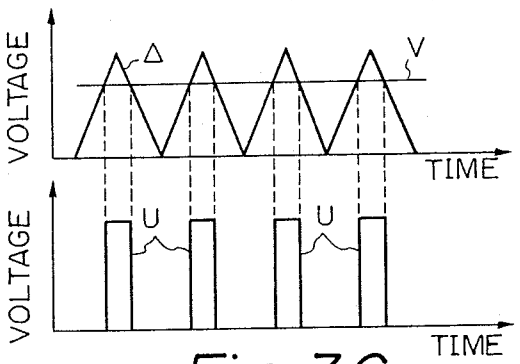
FIG. 3A is a graph showing a displacement control voltage signal obtained according to a superposed comparison of a reference triangular-wave signal and a displacement command voltage signal generated in response to a detected suction pressure.

If the computed rotational acceleration $\alpha$ is larger than the set value $\alpha_0$, the microcomputer 24 outputs a displacement rapid reduction command voltage signal V1 as shown in FIG. 3B. The comparator 26 superposes and compares the displacement rapid reduction voltage signal V1 with the triangular-wave signal $\Delta$ to output a rectangular displacement control voltage signal Ua corresponding to superposed regions of the signals V1 and $\Delta$. Then, the solenoid-operated control valve 15 is opened according to the displacement control voltage signal Ua having a duty ratio remarkably larger than that of the displacement control voltage signal U of FIG. 3A.

Therefore, an opening period per unit interval of the pressure control passages 20, **19*a* and 21 is extended so that an amount of the high-pressure refrigerant gas flowing from the discharge chamber 3*b* to the crankcase chamber 2*a* through the pressure control passages 20, 19*a* and 21 is rapidly increased. This rapid pressure increase exceeds a pressure releasing action of the pressure releasing passage la and, therefore, the pressure level in the crankcase chamber 2*a*** rises rapidly to decrease a displacement of the compressor in a short time.

Figure 2:
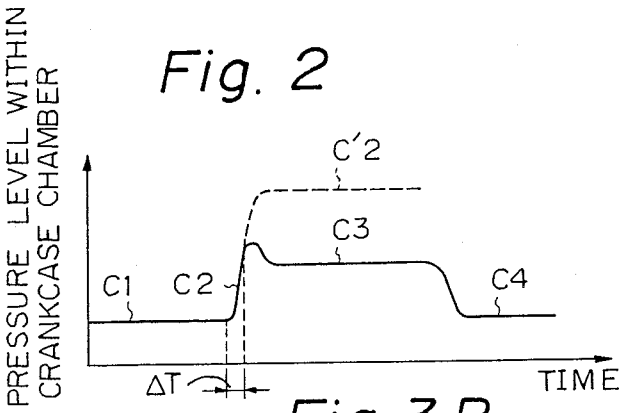
FIG. 2 is a graph showing pressure levels in a crankcase chamber.
Figure 3C:
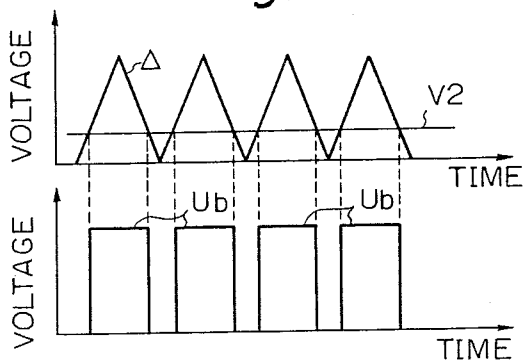
FIG. 3C is a graph showing a displacement control voltage signal obtained according to a superposed comparison of the reference triangular-wave signal and a reduced displacement keeping command voltage signal.

When a set interval $\Delta T$ elapses after the generation of the displacement rapid reduction command voltage signal V1, a reduced displacement keeping command voltage signal V2 of FIG. 3C is output instead of the command voltage signal V1. The comparator 26 superposes and compares the command voltage signal V2 with the triangular-wave signal $\Delta$ to output a rectangular displacement control voltage signal Ub having a duty ratio smaller than the duty ratio of the signal Ua but larger than the duty ratio of the signal U. According to the displacement control voltage signal Ub, the opening period per unit interval of the pressure control passages 20, **19*a* and 21 is shortened compared to that derived from the displacement rapid reduction command signal V1 so that an amount of the high-pressure refrigerant gas flowing from the discharge chamber 3*b* to the crankcase chamber 2*a* is decreased. As a result, the pressure releasing action of the pressure releasing passage 1*a* suppresses a pressure increase in the crankcase chamber 2*a*, and therefore, the pressure level in the crankcase 2*a*** is suppressed to an extent sufficient to maintain the reduced displacement, as indicated by a curve C3 of FIG. 2.

A curve C'2 of a dotted line shown in FIG. 2 represents an imaginary pressure level in the crankcase chamber **2*a* with the displacement rapid reduction command signal V1 being continuously output. Under this state, connections between the piston rod 14 and the piston 13, between the piston rod 14 and the wobble plate 11 and between the rotatable drive plate 8 and the wobble plate 11** are subjected to excessive load and may be damaged.

According to the present invention, after a displacement of the compressor is reduced to a required range, a pressure level in the crankcase chamber **2*a*** is suppressed to a value only for maintaining the reduced displacement. Therefore, the present invention may avoid the above-mentioned damage while achieving a rapid reduction of the displacement.

While the computed rotational acceleration $\alpha$ is larger than the set value $\alpha_0$, the microcomputer 24 continues to output the reduced displacement keeping command voltage signal V2. When the computed rotational acceleration $\alpha$ becomes smaller than the set value $\alpha_0$, the microcomputer 24 stops the output of the reduced displacement keeping command voltage signal V2 and shifts to the displacement control according to a detected suction pressure. Namely, during the displacement reduction demand period, i.e., during the acceleration of vehicle, the solenoid-operated control valve 15 is opened wider by the control voltage signals U1 and U2 having duty ratios larger than a normal control signal.

After shifting to the displacement control according to the detected suction pressure, the crankcase chamber **2*a*** is controlled to have a pressure level indicated with a curve C4 of FIG. 2. After that, the above-mentioned control procedure is repeated. Namely, a displacement of the compressor is controlled by judging whether or not a computed rotational acceleration is larger than the set value $\alpha_0$.

The present invention is not limited to the abovementioned embodiment. For example, instead of outputting the displacement rapid reduction command signal according to a rotational acceleration computed from a detected engine speed, the displacement rapid reduction command signal may be output according to ON and OFF operations of an acceleration switch which detects a motion of an acceleration pedal.

As described in the above, the present invention uses a displacement rapid reduction command signal to increase an opening control amount of a solenoid-operated control valve of a variable displacement wobble plate type compressor during a displacement reduction demand period. In an initial stage of the demand period, the opening control amount is temporarily increased further than that in the remaining demand period so that a pressure level in a crankcase chamber is rapidly increased to rapidly reduce a displacement of a compressor. After the reduction of the displacement, the reduced displacement is maintained by suppressing the pressure level in the crankcase chamber. As a result, damage to the portions in the crankcase chamber that are exposed to the increased pressure is prevented, while the displacement is rapidly reduced.

We claim:

1. A method of controlling the operation of a variable displacement wobble plate type compressor provided with:

a cylinder block having formed therein, a plurality of cylinder bores to receive therein compressor pistons;

a housing means arranged on axially opposite ends of the cylinder block for defining therein a suction chamber for a low pressure refrigerant gas to be compressed, a discharge chamber for a compressed high pressure refrigerant gas, and a crankcase chamber for receiving a pressure responsive displacement varying means including a drive shaft connectable to a rotative drive source means, a drive plate mounted around the drive shaft and capable of rotating with the drive shaft and varying an inclination angle thereof with respect to a plane vertical to the axis of the drive shaft and a wobble plate non-rotatably supported by the drive plate, the wobble plate inclining with the drive plate in response to a pressure difference between the crankcase chamber and the suction chamber, and connected to the compressor pistons via piston rods to cause a reciprocating motion of the compressor pistons with variable stroke to thereby vary the displacement of the compressor;

a solenoid-operated control valve means arranged in a pressure control passageway means extending from the discharge chamber to the crankcase chamber for changing an extent of fluid communication between the crankcase and discharge chambers; and a control means for electrically controlling the operation of the solenoid-operated control valve, comprising the steps of:

(a) generating a command signal for a rapid reduction in displacement of the compressor by said control means in response to a demand for a reduction of the displacement of the compressor;

(b) responding to the command signal, supplying the solenoid-operated control valve with an electrical energizing signal having a predetermined intensity greater than the intensity required to maintain a predetermined reduced displacement of the compressor to increase the extent of fluid communication between the crankcase and discharge chamber during a predetermined initial part of a time period in which the demand for a reduction of the displacement of the compressor is required; and (c) reducing the electrical energizing signal supplied to the solenoid-operated control valve to the intensity required to maintain the predetermined reduced displacement of the compressor for the remaining part of the time period in which demand for the reduction of the displacement of the compressor continues.

2. The method according to claim 1, wherein said rotative drive source means is an engine of a vehicle, and wherein said demand for a reduction of a displacement of the compressor comprises a demand for an acceleration of a speed of said vehicle.

3. The method according to claim 1, wherein said solenoid-operated control valve comprises a valve element movable to open and close an opening formed in said pressure control passageway means extending from the discharge chamber to the crankcase chamber, and a solenoid element electromagnetically moving said valve element between positions at which said opening in said pressure control passageway means is opened and closed 4. The method according to claim 1, wherein said predetermined intensity of electrical energizing signal supplied to said solenoid-operated control valve comprises an electrical voltage signal having a duty ratio having a predetermined value.

5. The method according to claim 3, wherein the step of reducing the electrical energizing signal supplied to the solenoid-operated control valve to the intensity required to maintain the predetermined reduced displacement of the compressor, comprises the step of reducing said duty ratio of said electrical voltage signal to said predetermined value.

* * * * *